US010801512B2

(12) United States Patent
Oklejas, Jr.

(10) Patent No.: US 10,801,512 B2
(45) Date of Patent: Oct. 13, 2020

(54) THRUST BEARING SYSTEM AND METHOD FOR OPERATING THE SAME

(71) Applicant: VECTOR TECHNOLOGIES, LLC, Monroe, MI (US)

(72) Inventor: Eli Oklejas, Jr., Newport, MI (US)

(73) Assignee: Vector Technologies LLC, Monroe, MI (US)

( * ) Notice: Subject to any disclaimer, the term of this patent is extended or adjusted under 35 U.S.C. 154(b) by 254 days.

(21) Appl. No.: 15/986,205

(22) Filed: May 22, 2018

(65) Prior Publication Data

US 2018/0340545 A1 Nov. 29, 2018

Related U.S. Application Data

(60) Provisional application No. 62/509,914, filed on May 23, 2017.

(51) Int. Cl.
*F04D 29/041* (2006.01)
*F04D 29/22* (2006.01)
(Continued)

(52) U.S. Cl.
CPC ..... *F04D 29/0413* (2013.01); *F04D 13/04* (2013.01); *F04D 13/043* (2013.01);
(Continued)

(58) Field of Classification Search
CPC ..... F04D 29/0413; F04D 13/043; F04D 29/2266; F04D 29/0416; F04D 29/66; F04D 29/5866; F04D 29/046; F04D 13/04
See application file for complete search history.

(56) References Cited

U.S. PATENT DOCUMENTS 659,930 A 10/1900 Kemble
893,127 A 7/1908 Barber
(Continued)

FOREIGN PATENT DOCUMENTS

CH 330272 A 5/1958
DE 1094592 B 12/1960
(Continued)

OTHER PUBLICATIONS

El-Sayed, E., et al.: "Performance evaluation of two RO membrane configurations in a MSF/RO hybrid system"; Desalination, Elsevier, Amsterdam, NL, vol. 128, No. 3, May 1, 2000 (May 1, 2000), pp. 231-245, SP004204830; ISSN: 0011-9164; pp. 232-234; figure 1.
(Continued)

*Primary Examiner* — Eldon T Brockman
(74) *Attorney, Agent, or Firm* — Harness, Dickey & Pierce, P.L.C.

(57) ABSTRACT

A fluid machine and method of operating the same includes a pump portion having a pump impeller chamber, a pump inlet and a pump outlet, a turbine portion having a turbine impeller chamber, a turbine inlet and a turbine outlet and a shaft extending between the pump impeller chamber and the turbine impeller chamber. The fluid machine also includes a first bearing and a second bearing spaced apart to form a balance disk chamber. A balance disk is coupled to the shaft and is disposed within the balance disk chamber and a turbine impeller coupled to the impeller end of the shaft disposed within the impeller chamber. A first thrust bearing is formed between the balance disk and the first bearing. The thrust bearing receives fluid from at least one of the pump outlet or the turbine inlet.

23 Claims, 9 Drawing Sheets

(51) Int. Cl.

| | |
|---|---|
| ***F04D 13/04*** | (2006.01) |
| ***F04D 29/046*** | (2006.01) |
| ***F04D 29/58*** | (2006.01) |
| ***F04D 29/66*** | (2006.01) |

(52) U.S. Cl.
CPC ..... *F04D 29/046* (2013.01); *F04D 29/0416* (2013.01); *F04D 29/2266* (2013.01); *F04D 29/5866* (2013.01); *F04D 29/66* (2013.01)

(56) References Cited

U.S. PATENT DOCUMENTS

| | | | | |
|---|---|---|---|---|
| 1,022,683 | A | 4/1912 | Kienast | |
| 1,024,111 | A | 4/1912 | Anderson | |
| 1,066,581 | A | 7/1913 | Brown | |
| 1,146,078 | A | 7/1915 | Oklejas, Jr. | |
| 1,323,412 | A | 12/1919 | Schorr | |
| 1,654,907 | A | 1/1928 | Wood | |
| 2,449,297 | A | 9/1948 | Hoffer | |
| 2,715,367 | A | 8/1955 | Kodet | |
| 2,717,182 | A * | 9/1955 | Goddard | F01D 21/08 384/121 |
| 2,748,714 | A | 6/1956 | Henry | |
| 3,160,108 | A | 12/1964 | Sence | |
| 3,220,349 | A | 11/1965 | White | |
| 3,563,618 | A | 2/1971 | Ivanov | |
| 3,614,259 | A | 10/1971 | Neff | |
| 3,664,758 | A | 5/1972 | Sato | |
| 3,671,137 | A | 6/1972 | Ball | |
| 3,748,057 | A | 7/1973 | Eskeli | |
| 3,828,610 | A | 8/1974 | Swearingen | |
| 3,969,804 | A | 7/1976 | MacInnes et al. | |
| 3,999,377 | A | 12/1976 | Oklejas et al. | |
| 4,028,885 | A | 6/1977 | Ganley et al. | |
| 4,029,431 | A | 6/1977 | Bachl | |
| 4,187,173 | A | 2/1980 | Keefer | |
| 4,230,564 | A | 10/1980 | Keefer | |
| 4,243,523 | A | 1/1981 | Pelmulder | |
| 4,255,081 | A | 3/1981 | Oklejas et al. | |
| 4,288,326 | A | 9/1981 | Keefer | |
| 4,353,874 | A | 10/1982 | Keller et al. | |
| 4,432,876 | A | 2/1984 | Keefer | |
| 4,434,056 | A | 2/1984 | Keefer | |
| 4,472,107 | A | 9/1984 | Chang et al. | |
| RE32,144 | E | 5/1986 | Keefer | |
| 4,632,756 | A | 12/1986 | Coplan et al. | |
| 4,702,842 | A | 10/1987 | Lapierre et al. | |
| 4,830,572 | A | 5/1989 | Oklejas, Jr. et al. | |
| 4,867,633 | A | 9/1989 | Gravelle | |
| 4,966,708 | A | 10/1990 | Oklejas et al. | |
| 4,973,408 | A | 11/1990 | Keefer | |
| 4,983,305 | A | 1/1991 | Oklejas et al. | |
| 4,997,357 | A | 3/1991 | Eirich et al. | |
| 5,020,969 | A | 6/1991 | Mase et al. | |
| 5,049,045 | A | 9/1991 | Oklejas et al. | |
| 5,082,428 | A | 1/1992 | Oklejas et al. | |
| 5,106,262 | A | 4/1992 | Oklejas et al. | |
| 5,132,090 | A | 7/1992 | Volland | |
| 5,133,639 | A | 7/1992 | Gay et al. | |
| 5,154,572 | A | 10/1992 | Toyoshima et al. | |
| 5,163,812 | A | 11/1992 | Klaus | |
| 5,320,755 | A | 6/1994 | Hagqvist et al. | |
| 5,338,151 | A | 8/1994 | Kemmner et al. | |
| 5,340,286 | A | 8/1994 | Kanigowski | |
| 5,482,441 | A | 1/1996 | Permar | |
| 5,499,900 | A | 3/1996 | Khmara et al. | |
| 5,702,229 | A | 12/1997 | Moss et al. | |
| 5,819,524 | A | 10/1998 | Bosley et al. | |
| 5,951,169 | A | 9/1999 | Oklejas et al. | |
| 5,980,114 | A | 11/1999 | Oklejas, Jr. | |
| 6,007,723 | A | 12/1999 | Ikada et al. | |
| 6,017,200 | A | 1/2000 | Childs et al. | |
| 6,036,435 | A | 3/2000 | Oklejas | |
| 6,071,091 | A | 6/2000 | Lemieux | |
| 6,110,375 | A | 8/2000 | Bacchus et al. | |
| 6,116,851 | A | 9/2000 | Oklejas, Jr. | |
| 6,120,689 | A | 9/2000 | Tonelli et al. | |
| 6,139,740 | A | 10/2000 | Oklejas | |
| 6,187,200 | B1 | 2/2001 | Yamamura et al. | |
| 6,190,556 | B1 | 2/2001 | Uhlinger | |
| 6,309,174 | B1 | 10/2001 | Oklejas, Jr. et al. | |
| 6,345,961 | B1 | 2/2002 | Oklejas, Jr. | |
| 6,468,431 | B1 | 10/2002 | Oklelas, Jr. | |
| 6,589,423 | B1 | 7/2003 | Chancellor | |
| 6,713,028 | B1 | 3/2004 | Oklejas, Jr. | |
| 6,797,173 | B1 | 9/2004 | Oklejas, Jr. | |
| 6,881,336 | B2 | 4/2005 | Johnson | |
| 6,932,907 | B2 | 8/2005 | Haq et al. | |
| 7,077,962 | B2 | 7/2006 | Pipes | |
| 7,150,830 | B1 | 12/2006 | Katsube et al. | |
| 8,016,545 | B2 * | 9/2011 | Oklejas, Jr. | F04D 29/0416 415/106 |
| 8,529,191 | B2 | 9/2013 | Oklejas, Jr. | |
| 9,677,569 | B2 | 6/2017 | Hunt | |
| 2003/0080058 | A1 | 5/2003 | Kimura et al. | |
| 2004/0211729 | A1 | 10/2004 | Sunkara et al. | |
| 2006/0157409 | A1 | 7/2006 | Hassan | |
| 2006/0157410 | A1 | 7/2006 | Hassan | |
| 2006/0226077 | A1 | 10/2006 | Stark | |
| 2007/0056907 | A1 | 3/2007 | Gordon | |
| 2007/0199878 | A1 | 8/2007 | Eisberg et al. | |
| 2007/0289904 | A1 | 12/2007 | Oklejas | |
| 2007/0292283 | A1 * | 12/2007 | Oklejas | F04D 29/0416 417/309 |
| 2007/0295650 | A1 | 12/2007 | Yoneda et al. | |
| 2016/0177963 | A1 | 6/2016 | Danguy et al. | |

FOREIGN PATENT DOCUMENTS

| | | | |
|---|---|---|---|
| DE | 1936121 | A1 | 1/1971 |
| DE | 3510160 | A1 | 9/1986 |
| EP | 0547279 | A1 | 6/1993 |
| EP | 0952352 | A2 | 10/1999 |
| EP | 1508361 | A1 | 2/2005 |
| EP | 1717449 | A2 | 11/2006 |
| EP | 1798419 | A2 | 6/2007 |
| EP | 2302201 | A2 | 3/2011 |
| FR | 2624226 | A1 | 6/1989 |
| FR | 2775321 | A1 | 8/1999 |
| GB | 2363741 | A | 1/2002 |
| WO | WO-02/09855 | A1 | 2/2002 |
| WO | WO-06/106158 | A1 | 10/2006 |
| WO | WO-07/146321 | A1 | 12/2007 |
| WO | WO-2010091036 | A1 | 8/2010 |

OTHER PUBLICATIONS

Geisler, P., et al.: Reduction of the energy demand for seawater RO with the pressure exchange system PES:; Desalination, Elsevier, Amsterdam, NL, vol. 135, No. 1-3, Apr. 20, 2001 (Apr. 20, 2001), pp. 205-210, SP004249642; ISSN: 0011-9164; the whole document. International Search Report Completed Jul. 24, 2018.

* cited by examiner

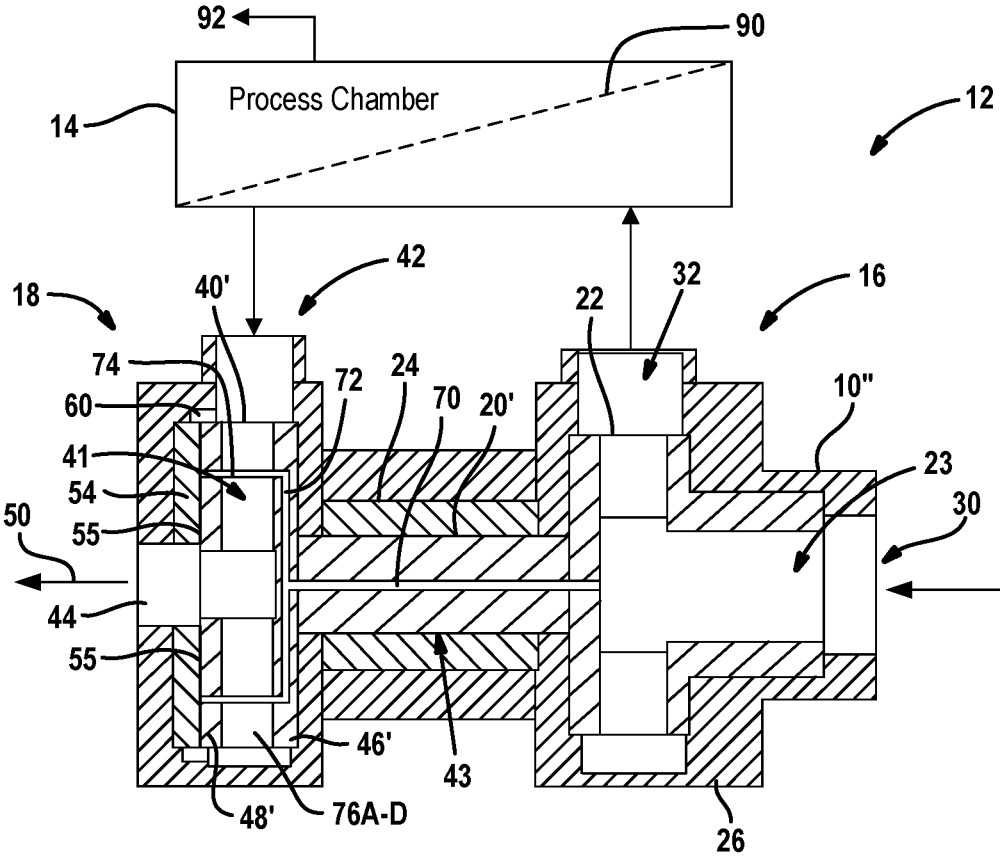
FIG. 2
Prior Art
FIG. 3
Prior Art
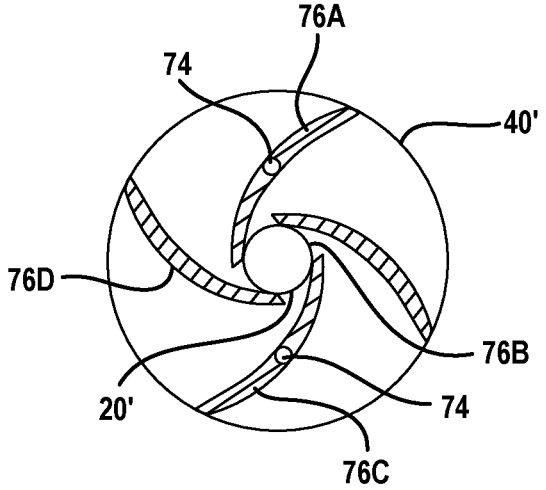

THRUST BEARING SYSTEM AND METHOD FOR OPERATING THE SAME

CROSS-REFERENCE TO RELATED APPLICATIONS

This application claims the benefit of U.S. Provisional Application No. 62/509,914 filed on May 23, 2017. The disclosure of the above application is incorporated herein by reference.

TECHNICAL FIELD

The present disclosure relates generally to a fluid machine, and, more specifically, to thrust bearing lubrication for axial thrust force compensation within the fluid machine suitable for high contaminant or gas bubble environments.

BACKGROUND

The statements in this section merely provide background information related to the present disclosure and may not constitute prior art.

Rotating fluid machines are used in many applications for many processes. Lubrication for a rotating fluid machine is important. Various types of fluid machines use a thrust bearing that is lubricated by the pumpage. Adequate flow of pumpage should be supplied to obtain proper lubrication. Fluid machines are used under various conditions. During normal operating conditions, lubrication may be relatively easy. However, under various operating conditions contaminants or bubbles may be present in the pumpage. Contaminants and pumpage may affect the lubrication provided by the thrust bearing. Losing lubrication may cause damage the fluid machine. Air entrainment or debris within the pumpage may cause upset conditions.

Referring now to FIG. 1, a hydraulic pressure booster (HPB) 10 is one type of fluid machine. The hydraulic pressure booster 10 is part of an overall processing system 12 that also includes a process chamber 14. Hydraulic pressure boosters may include a pump portion 16 and a turbine portion 18. A common shaft 20 extends between the pump portion 16 and the turbine portion 18. The HPB 10 may be free-running which means that it is solely energized by the turbine and will run at any speed where the equilibrium exists between a turbine output torque and the pump input torque. The rotor or shaft 20 may also be connected to an electric motor to provide a predetermined rotational rate.

The hydraulic pressure booster 10 is used to boost the process feed stream using energy from another process stream which is depressurized through the turbine portion 18.

The pump portion 16 includes a pump impeller 22 disposed within a pump impeller chamber 23. The pump impeller 22 is coupled to the shaft 20. The shaft 20 is supported by a bearing 24. The bearing 24 is supported within a casing 26. Both the pump portion 16 and the turbine portion 18 may share the same casing structure.

The pump portion 16 includes a pump inlet 30 for receiving pumpage and a pump outlet 32 for discharging fluid to the process chamber 14. Both of the pump inlet 30 and the pump outlet 32 are openings within the casing 26.

The turbine portion 18 may include a turbine impeller 40 disposed within a turbine impeller chamber 41. The turbine impeller 40 is rotatably coupled to the shaft 20. The pump impeller 22, the shaft 20 and the turbine impeller 40 rotate together to form a rotor 43. Fluid flow enters the turbine portion 18 through a turbine inlet 42 through the casing 26. Fluid flows out of the turbine portion 40 through a turbine outlet 44 also through the casing 26. The turbine inlet 42 receives high-pressure fluid and the outlet 44 provides fluid at a pressure reduced by the turbine impeller 40.

The impeller 40 is enclosed by an impeller shroud. The impeller shroud includes an inboard impeller shroud 46 and an outboard impeller shroud 48. During operation the pump impeller 22, the shaft 20 and the turbine impeller 40 are forced in the direction of the turbine portion 18. In FIG. 1, this is in the direction of the axial arrow 50. The impeller shroud 48 is forced in the direction of a thrust bearing 54.

The thrust bearing 54 may be lubricated by pumpage fluid provided from the pump inlet 30 to the thrust bearing 54 through an external tube 56. A gap or layer of lubricating fluid may be disposed between the thrust bearing 54 and outboard impeller shroud which is small and is thus represented by the space 55 therebetween. A filter 58 may be provided within the tube to prevent debris from entering the thrust bearing 54. At start-up, the pressure in the pump portion 16 is greater than the thrust bearing and thus lubricating flow will be provided to the thrust bearing 54. During operation, the pressure within the turbine portion 18 will increase and thus fluid flow to the thrust bearing 54 may be reduced. The thrust bearing 54 may have inadequate lubricating flow during operation. Also, when the filter 58 becomes clogged, flow to the thrust bearing 54 may be interrupted. The thrust bearing 54 generates a force during normal operation in the opposite direction of arrow 50.

Referring now to FIG. 2, a first example of a hydraulic-pressure booster 10" is illustrated. In this example, the common components from FIG. 1 are provided with the same reference numerals are not described further. In this example, a hollow shaft 20' is used rather than the solid shaft illustrated in FIG. 1. The hollow shaft 20' has a shaft passage 70 that is used for passing pumpage from the impeller chamber 23 of the pump portion 16 to the turbine portion 18. The passage 20 may provide pumpage from the pump inlet 30.

The inboard shroud 46' includes radial passages 72. The radial passages 72 are fluidically coupled to the shaft passage 70. Although only two radial passages 72 are illustrated, multiple radial passages may be provided.

The impeller 40' may include vanes 76A-D as is illustrated in FIG. 3. The impeller 40' includes axial passages 74. The axial passages 74 may be provided through vanes 76A and 76C of the impeller 40'. The axial passages are parallel to the axis of the HPB 10" and the shaft 20'. The axial passages 74 extend partially through the inner impeller shroud 46' and entirely through the outboard impeller shroud 48'. The axial passages 74 terminate adjacent to the thrust bearing 54. Again the gap between the outboard impeller shroud 48' and the thrust bearing 54 is small and thus is represented by the line 55 in the Figure therebetween. The lubrication path for the thrust bearing 54 includes the shaft passage 70, the radial passages 72 and the axial turbine impeller passages 74.

In operation, at start-up pressure within the pump portion 16 is higher than the turbine portion 18. Fluid within the pump portion travels through the shaft passage 70 to the radial passages 72 and to the axial passage 74. When the fluid leaves the axial passage 74, the fluid is provided to the thrust bearing 54. More specifically, the fluid lubricates the space or gap 55 between the thrust bearing 54 and the outboard impeller shroud 48'. The thrust bearing 54 generates an inboard axial force in response to the lubricating fluid in the opposite direction of arrow 50.

The highest pressure in the pumpage occurs in the pump inlet 30 during startup. Passages downstream of the pump inlet are at lower pressure and thus fluid from the pump portion 16 flows to the turbine portion 18. Consequently, pumpage from the inlet is high during the startup. During shutdown of the equipment, the same factors apply due to the differential and pressure between the pump and the turbine. During normal operation, the highest pressure is no longer in the pump inlet but is at the pump outlet 32. Due to the arrangement of the lubrication passages, the pressure increases in the pumpage due to a pressure rise occurring in the radial passage 72 due to a centrifugal force generated by the rotation of the turbine impeller 40'. The amount of pressure generation is determined by the radial length of the radial passages 72 and the rate of the rotor rotation. Consequently, pumpage is provided to the thrust bearing at the startup, normal operation and shutdown of the fluid machine 10".

Referring now to FIG. 3, the impeller 40' is illustrated having four impeller vanes 76A-76D. Various numbers of vanes may be provided. The vanes extend axially relative to the axis of the shaft 20'. More than one impeller vane may have an axial passage 74. The axial passage 74 extends through the vanes 76 and the inboard impeller shroud 46' sufficient to intercept radial passage 72 and the outboard impeller shroud 48' which are illustrated in FIG. 2.

It should be noted that the process chamber 14 is suitable for various types of processes including a reverse osmosis system. For a reverse osmosis system, the process chamber may have a membrane 90 disposed therein. A permeate output 92 may be provided within the process chamber for desalinized fluid to flow therefrom. Brine fluid may enter the turbine inlet 42. Of course, as mentioned above, various types of process chambers may be provided for different types of processes including natural gas processing and the like.

Referring now to FIG. 4, an example similar to that of FIG. 2 is illustrated and is thus provided the same reference numerals. In this example, a deflector 110 is provided within the pump inlet 30. The deflector 110 may be coupled to the pump impeller 22 using struts 112. The struts 112 may hold the deflector 110 away from the pump impeller so that a gap is formed therebetween that allows fluid to flow into the shaft passage 70.

The deflector 110 may be cone-shaped and have an apex 114 disposed along the axis of the shaft 20'. The cone shape of the deflector 110 will deflect debris in the pumpage into the pump impeller 22 and thus prevent passage of debris into the shaft passage 70. Unlike the filter 58 illustrated in FIG. 1, the debris is deflected away from the shaft passage 70 and thus will not clog the shaft passage 70.

Referring now to FIG. 5, the turbine portion 18 is illustrated having another example of a thrust bearing 54'. The thrust bearing 54' may include an outer land 210 and an inner land 212. A fluid cavity 214 is disposed between the outer land 210, the inner land 212 and the outer shroud 48'. It should be noted that the thrust bearing 54' of FIG. 5 may be included in the examples illustrated in FIGS. 2 and 4.

The outer land 210 is disposed adjacent to the annular clearance 60. The inner land 212 is disposed adjacent to the turbine outlet 44. The thrust bearing 54' may be annular in shape and thus the outer land 210 and inner land 212 may also be annular in shape.

The cavity 214 may receive pressurized fluid from the pump portion 16 illustrated in FIGS. 2 and 4. That is, pumpage may be received through the shaft passage 70, the radial passages 72 and the axial passages 74.

Slight axial movements of the shaft 20 in the attached impeller shroud 48' may cause variations in the axial clearance 220 between the lands 210 and 212 relative to the outer shroud 48'. If the axial clearances 220 increase, the pressure in the fluid cavity 214 decreases due to an increase of leakage through the clearances 220. Conversely, if the axial gap of the clearance 220 decreases, the pressure will rise in the fluid cavity 214. The pressure variation counteracts the variable axial thrust generated during operation and ensures that the lands 210 and 212 do not come into contact with the impeller shroud 48'.

The reduction in pressure is determined by the flow resistance in the passages 70-74. The passages are sized to provide a relationship between the rate of leakage and the change in pressure in the fluid cavity 214 as a function of the axial clearance. The radial location of the passage 74 determines the amount of centrifugally generated pressure rise and is considered in ensuring an optimal leakage in addition to the diameters of the flow channel. Excessive leakage flow may impair the efficiency and insufficient fluid flow will allow clearances to be too small and allow frictional contact during operation.

The pressure in the fluid cavity is higher than the turbine outlet 44 and the pressure in the outer diameter of the impeller in the annular clearance 60 when the passage 74 is at the optimal radial location. Leakage will thus be out of cavity 214 to allow a desired pressure variation within the fluid cavity 214.

Referring now to FIG. 6, an example similar to that of FIG. 5 is illustrated. The inner land 212 is replaced by a bushing 230. The bushing 230 may form a cylindrical clearance relative to the impeller wear ring 232. The fluid cavity 214 is thus defined between the wear ring 232, the bushing 230 and the outer land 210.

Referring now to FIG. 7, vane 240 of an impeller 242 having curvature in the axial plane as well as the radial plane is illustrated. The impeller 242 may be used in a mixed flow design. In this example, the outer land 210' and inner land 212' are formed according to the shape of the impeller 242. The fluid cavity 214' may also be irregular in shape between the outer land 210' and the inner land 212'.

The fluid passage 250 provides fluid directly to the fluid cavity 214' in a direction at an angle to the longitudinal axis of the fluid machine and shaft 20'. Thus, the radial passages 72 and axial passages 74 are replaced with the diagonal passage 250. The diagonal passage 250 may enter the fluid cavity 214' at various locations including near the land 212' or at another location such as near land 210'. Various places between land 210' and 212' may also receive the diagonal passage 250.

Further areas of applicability will become apparent from the description provided herein. It should be understood that the description and specific examples are intended for purposes of illustration only and are not intended to limit the scope of the present disclosure.

SUMMARY

This section provides a general summary of the disclosure, and is not a comprehensive disclosure of its full scope or all of its features.

The present disclosure provides an improved method for lubricating a rotating process machine during operation. The system provides pumpage to the thrust bearing over the entire operating range of the device.

In one aspect of the invention, a fluid machine comprises a pump portion having a pump impeller chamber, a pump inlet and a pump outlet, a turbine portion having a turbine impeller chamber, a turbine inlet and a turbine outlet and a shaft extending between the pump impeller chamber and the turbine impeller chamber. The fluid machine also includes a first bearing and a second bearing spaced apart to form a balance disk chamber. A balance disk is coupled to the shaft and is disposed within the balance disk chamber and a turbine impeller coupled to the impeller end of the shaft disposed within the impeller chamber. A first thrust bearing is formed between the balance disk and the first bearing. The thrust bearing receives fluid from at least one of the pump outlet or the turbine inlet.

In another aspect of the invention, a method for operating a fluid machine includes communicating fluid from a pump outlet or a turbine inlet to a thrust bearing formed by a balance disk coupled to a shaft, rotating the balance disk between a first bearing and a second bearing, and generating an axial force in response to communicating fluid in response to communicating and generating.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

FIG. 2 is a cross-sectional view of a first fluid machine according to the prior art.

FIG. 3 is an end view of an impeller of FIG. 2.

DETAILED DESCRIPTION

Figure 1:
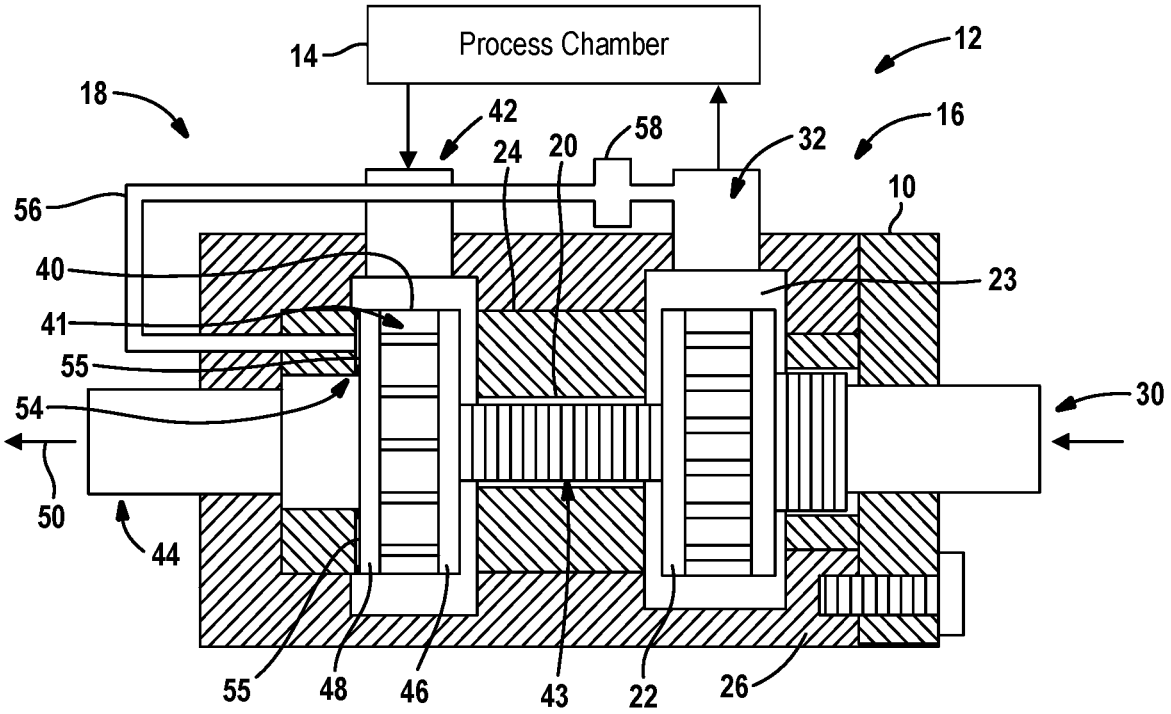
FIG. 1 Prior Art
FIG. 1 is a cross-sectional view of a first turbocharger according to the prior art.
Figure 4:
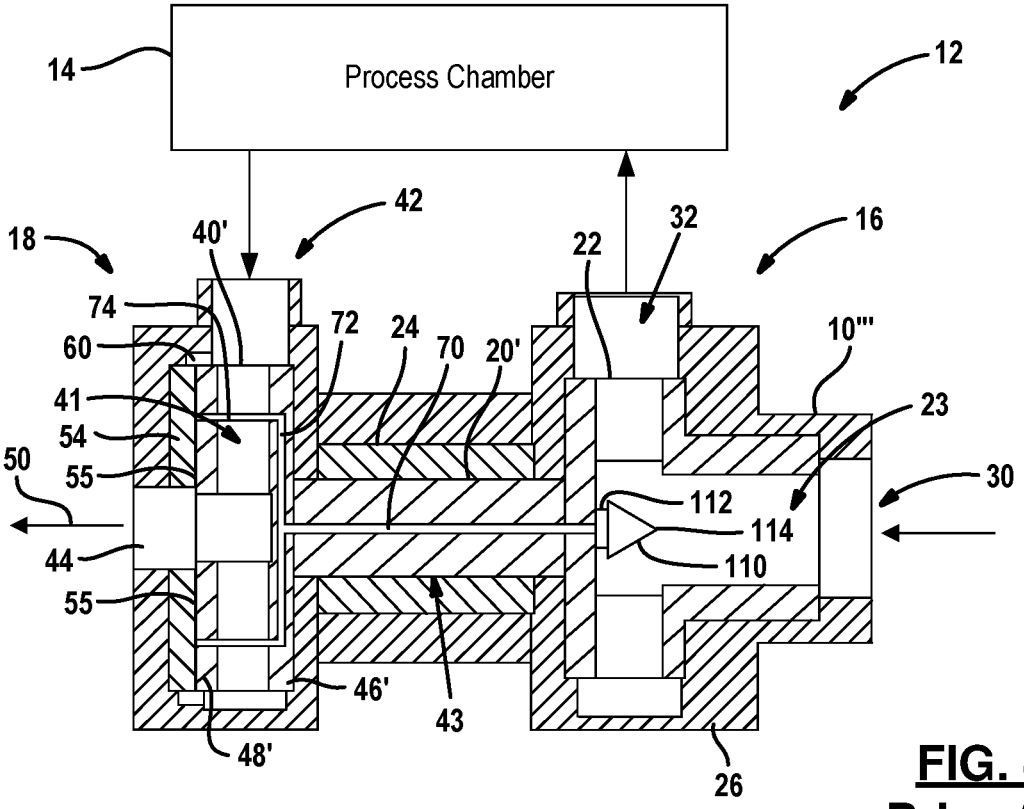
FIG. 4 Prior Art
FIG. 4 is a cross-sectional view of a second fluid machine according to the prior art.
Figure 5:
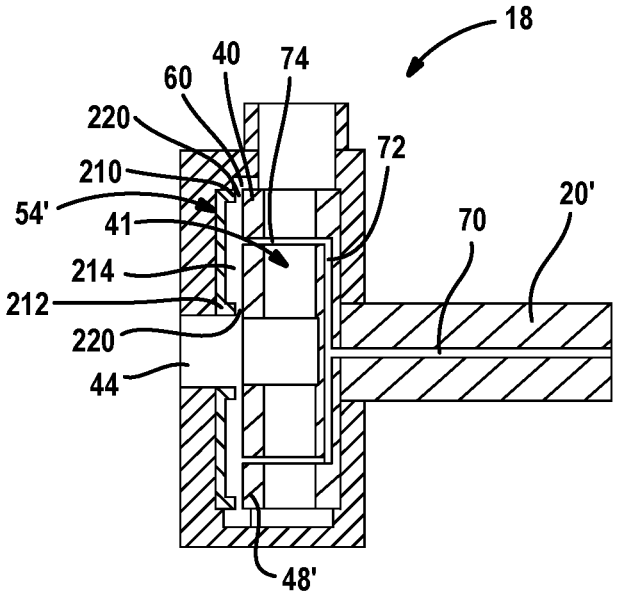
FIG. 5 Prior Art
FIG. 5 is a cross-sectional view of a third example of a turbine portion according to the prior art.
Figure 6:
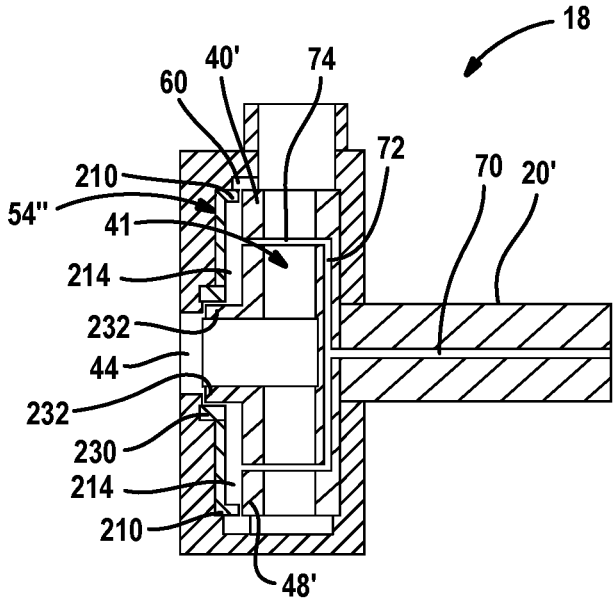
FIG. 6 Prior Art
FIG. 6 is a cross-sectional view of a fourth example of a turbine portion according to the prior art.
Figure 7:
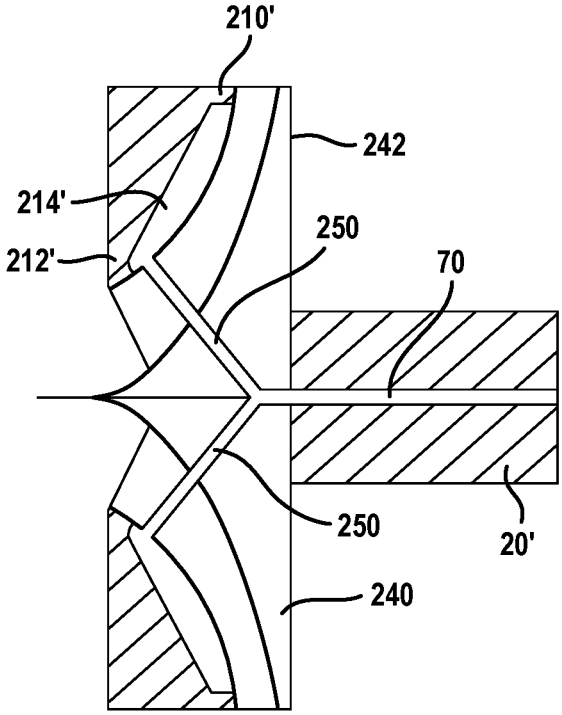
FIG. 7 Prior Art
FIG. 7 is a cross-sectional view of an alternative example of an impeller of the prior art.

The following description is merely exemplary in nature and is not intended to limit the present disclosure, application, or uses. For purposes of clarity, the same reference numbers will be used in the drawings to identify similar elements. As used herein, the phrase at least one of A, B, and C should be construed to mean a logical (A or B or C), using a non-exclusive logical OR. It should be understood that steps within a method may be executed in different order without altering the principles of the present disclosure.

In the following description, a hydraulic pressure booster having a turbine portion and pump portion is illustrated. However, the present disclosure applies equally to other fluid machines. The present disclosure provides a way to deliver pumpage to a thrust bearing over the operating range of the device. Debris entering the turbine is also reduced.

Figure 8A:
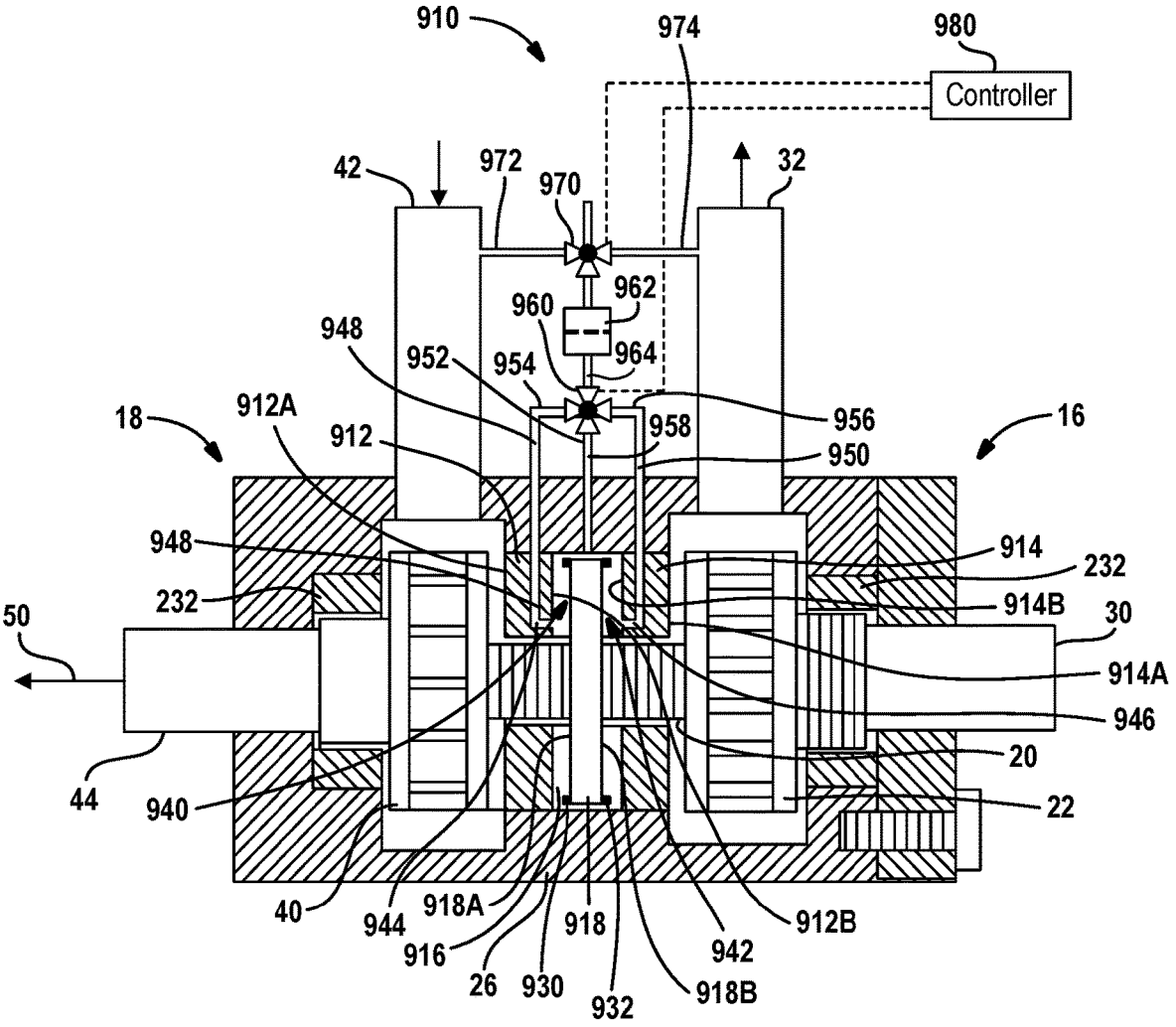
FIG. 8A is a cross-sectional view of a first example according to the present disclosure.

Referring now to FIG. 8A, a hydraulic pressure booster 910 according to the present disclosure is set forth. In this example, the components with the same reference numerals described above in FIGS. 1-7 are set forth. In this example, the hydraulic pressure booster 910 includes a first bearing 912 and a second bearing 914 that are spaced apart. In this example, the bearing 912 may be referred to as a turbine bearing and the bearing 914 may be referred to as a pump bearing. The pump bearing 914 and turbine bearing 912 define a balance disk chamber 916. The balance disk chamber 916 houses a balance disk 918 which is rotatably coupled to the common shaft 20. The bearing 912 has a first side 912A that is disposed adjacent to the turbine impeller 40 and a second side 912B within the balance disk chamber 916. The bearing 914 has a first side 914A adjacent to the pump impeller 22 and a second side 914B within the balance disk chamber 916. The bearings 912 and 914 provide radial support for the shaft 920. The turbine outlet 44 is coaxial with the shaft 20.

The balance disk 918 has a first surface 918A that faces surface 912B and a second surface 918B that faces the second surface 914B. Surface 918A has a land 930. The second surface 918B has a second land 932. The lands 930 and 932 are annular in shape. In an alternate example, the land 930 may be disposed on the surface 912B. Land 932 may also be disposed on the surface 914B.

A first thrust bearing 940 is defined by the volume between the first surface 912B, surface 918A and the first land 930. A second thrust bearing 942 is defined between the surface 914B, surface 918B and the land 932. The thrust bearing and the land 932. The thrust bearings 940, 942 are provided with process fluid from either the turbine flow or the feed flow as will be defined below. Fluid is communicated to the first thrust bearing 940 through an inlet port 944. Fluid is communicated to the second thrust bearing 942 through a port 946. The port 944 is in fluid communication with a channel 948 that extends through the bearing 912 and the casing 26. A channel 950 is in fluid communication with the port 946 through the bearing 914 and the casing 26. Another channel 952 may extend through the casing 26 and provide fluid adjacent to the balance disk 918.

A first pipe 954 may communicate fluid to the first channel 948. A second pipe 956 communicates processed fluid to the channel 950. Pipe 958 communicates fluid to the channel 950.

Each of the pipes 954, 956 and 958 may be in communication with a four-way valve 960. The four-way valve 960 selectively communicates fluid to the pipes 954-956. It should be noted that the four-way valve 960 may receive fluid from a filter 962. The filter 962 filters out contaminants from the process fluid before reaching the pipes 954-958. Fluid from the filter 962 is communicated through a pipe 964.

In operation, the four-way valve 960 may be eliminated if the hydraulic pressure booster 910 is used in one or selected operating conditions. That is, the loads acting on the shaft from the turbine impeller 40 or the pump impeller 22 may always act in a constant direction during operation. Thus, one of the channels 948-952 may be provided in the design while eliminating the others.

A three-way valve 970 is in communication with the turbine inlet 42 and the pump outlet 32 through pipes 972 and 974, respectively.

In operation, a counter thrust to balance the thrust of the rotor is provided with the balance disk 918 and the thrust bearings 940 and 942 associated therewith. As mentioned above, only one thrust bearing need be formed in certain design conditions. When the thrust indicated by arrow 50, which is toward the turbine portion, is present, lubrication flow may be admitted through the pipe 954 and into the channel 948 where it enters to form a thrust bearing through the port 944. Fluid enters the pipe through the four-way valve 960, the pipe 958 and the filter 962. Fluid may be communicated into the filter 962 through the three-way valve 970 which operates to provide fluid from either the turbine inlet 42 or the pump outlet 32. The three-way valve 970 may be controlled by a controller 980 which may be microprocessor-based. The controller 980 may also control the operation of the four-way valve 960.

If the thrust is directed toward the pump side of the HPB 910, lubrication flow may be admitted through channel 950 and pipe 956. Fluid is communicated through the four-way valve 960, the three-way valve 970 and from one of the turbine inlet 42 or the pump outlet 32.

As briefly mentioned above, it may also be desirable to communicate fluid simultaneously through the pipes 948 and 958. Likewise, it may be desirable to communicate fluid through pipes 950 and 958. The pipe 958 communicates fluid to the channel 952. The channel 952 provides fluid adjacent to the peripheral edge of the balance disk 918.

Figure 8B:
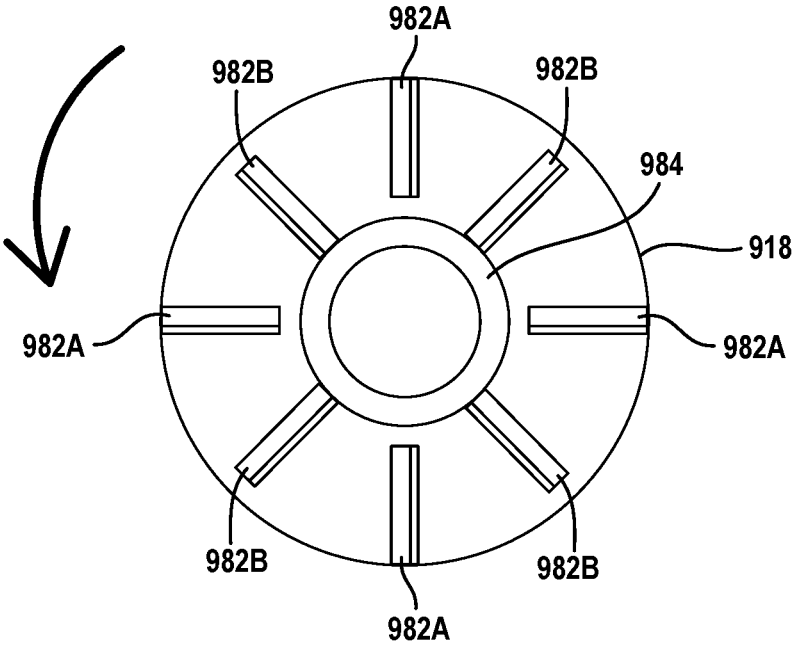
FIG. 8B is a front view of the balance disk of FIG. 8A.

Referring now to FIG. 8B, to increase the thrust force, hydrodynamic action of the balance disk 918 may be used. The balance disk 918 may be provided with a plurality of radially oriented surface recesses that generate hydrodynamic lift that increases in strength as the gap between the balance disk and the adjacent bearing face decreases. In this example, a first plurality of recesses 982A extends from the outer periphery of the balance disk 918 to just short of a groove 984. The groove 984 is a reduced thickness portion. It should be noted that each surface 918A, 918B of the balance disk may include such surfaces. However, only one surface in various designs may be used. The recesses 982B extend from the groove 984 to just short of the outer periphery of the balance disk 918. The recesses 982A and 982B are interspersed. That is, when traversing around the balance disk 918, the recesses 982A alternate with recesses 982B. In this example, there are four recesses 982A and four recesses 982B.

Figure 8C:
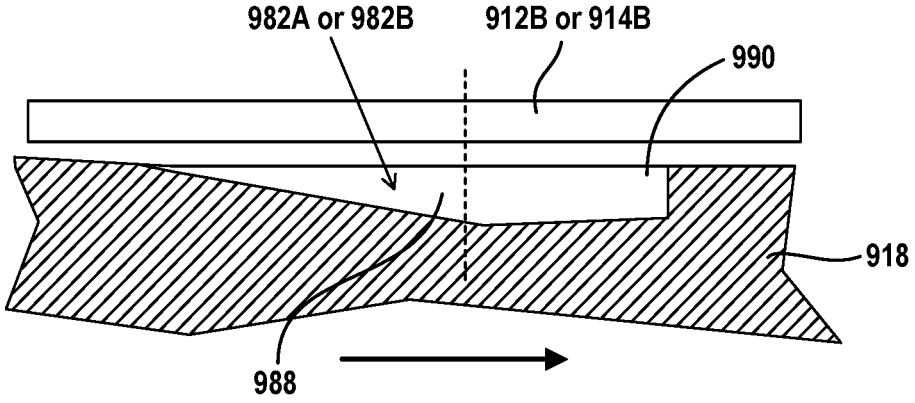
FIG. 8C is a cross-sectional view of the balance disk relative to a bearing surface of FIG. 8A.

Referring now to FIG. 8C, a cross-sectional view of the balance disk relative to one of the surfaces 912B or 914B is set forth. In this example, the balance disk is moving in the direction indicated by the arrow 986. Each of the recesses 982A or 982B may be formed according to the following. The recesses 982A or 982B include a tapered portion 988. The groove 990 is on the leading edge and thus pressure is built up in the tapered portion 988 due to the movement of the balance disk 918 in the direction indicated by the arrow 986.

Because the lubrication flow to the thrust bearings are filtered, the clearance between the surfaces 912B or 914B and the balance disk 918 may be small. The clearance is smaller than the distance between the wear rings 232.

Figure 8D:
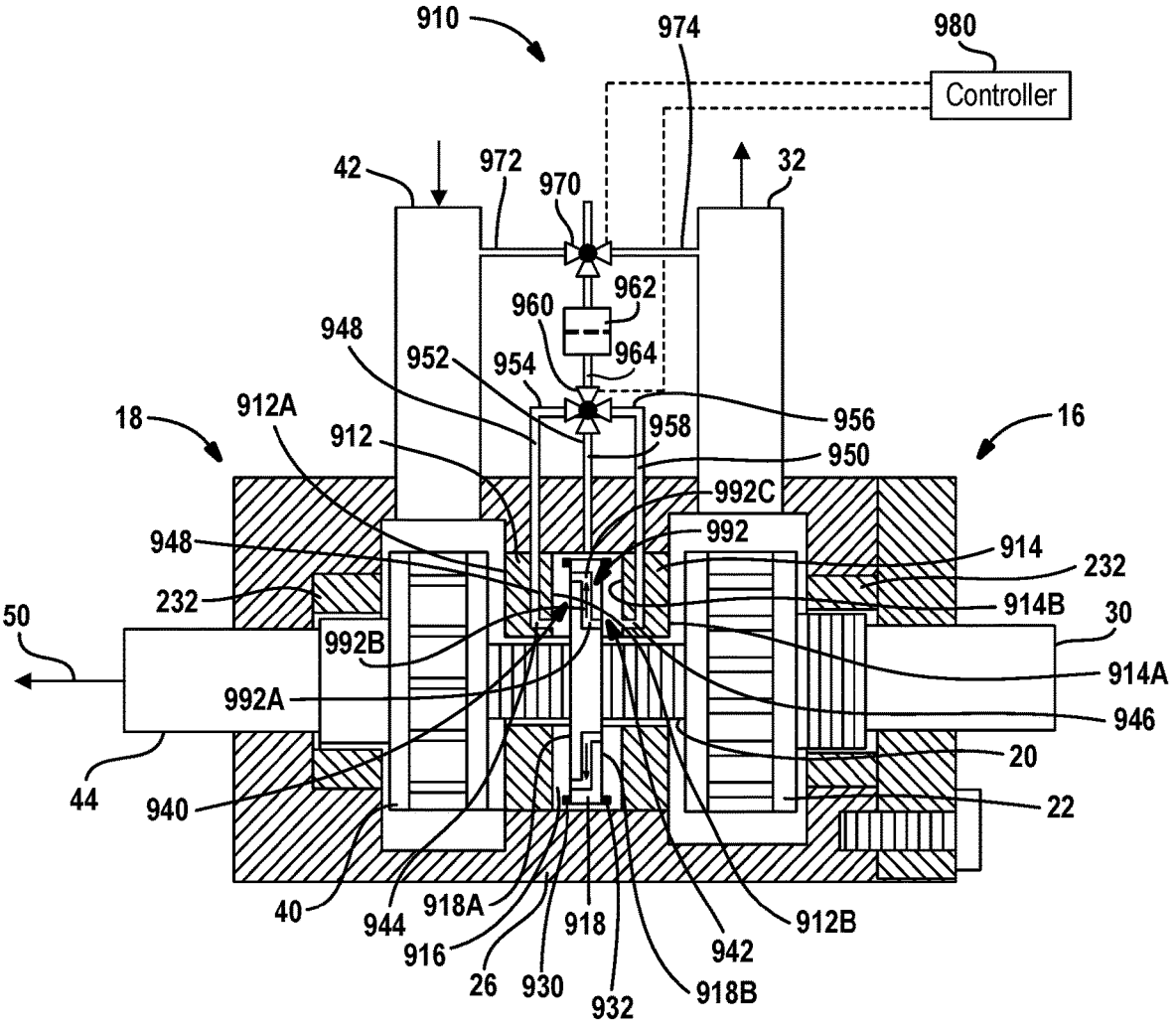
FIG. 8D is a cross-sectional view of a second example according to the present disclosure.

Referring now to FIG. 8D, the balance disk 918 includes a flow channel 992 therethrough. The flow channel 992 extends within the balance disk 918 and communicates fluid from a first side of the balance disk to a second side of the balance disk 918. In FIG. 8D, fluid is communicated from the pump side 918B of the balance disk 918 to the turbine side 918A of the balance disk 918.

The flow channel 992 has a first axial portion 992A that extends from the pump side 918B proximate to or adjacent to the shaft 20. A radial portion 992B extends in a radial direction from the first axial portion 992A. The radial portion 992B extends away from the shaft 20 in a radial direction direction. A second axial portion 992C couples the radial 992B to the second side of the balance disk 918.

In operation, fluid flows from the first side 918B of the balance disk 918 which corresponds to the pump side through the first axial portion 992A, through the radial portion 992B where the centrifugal forces cause an increase in the pressure of the fluid. The centrifugal force is caused by the high rate of rotation of the shaft 20 and the rotor associated therewith. Fluid exits to the second side 918A of the balance disk 918 through the second axial portion 992C into the thrust bearing formed on the first side 918A. The second axial portion 992C is located a further distance from the shaft 20 than the first axial portion 992A (radially outward). The flow channel 992 consequently increases the capacity of the thrust bearing at the turbine side of the balance disk 918.

It should be noted that a plurality of flow channels may be included in the balance disk. To provide balanced forces, the flow channels may be symmetrically disposed about the balance disk 918. It should also be noted that in FIG. 8D, the thrust forces that act on the shaft are in the direction toward the turbine side.

Figure 8E:
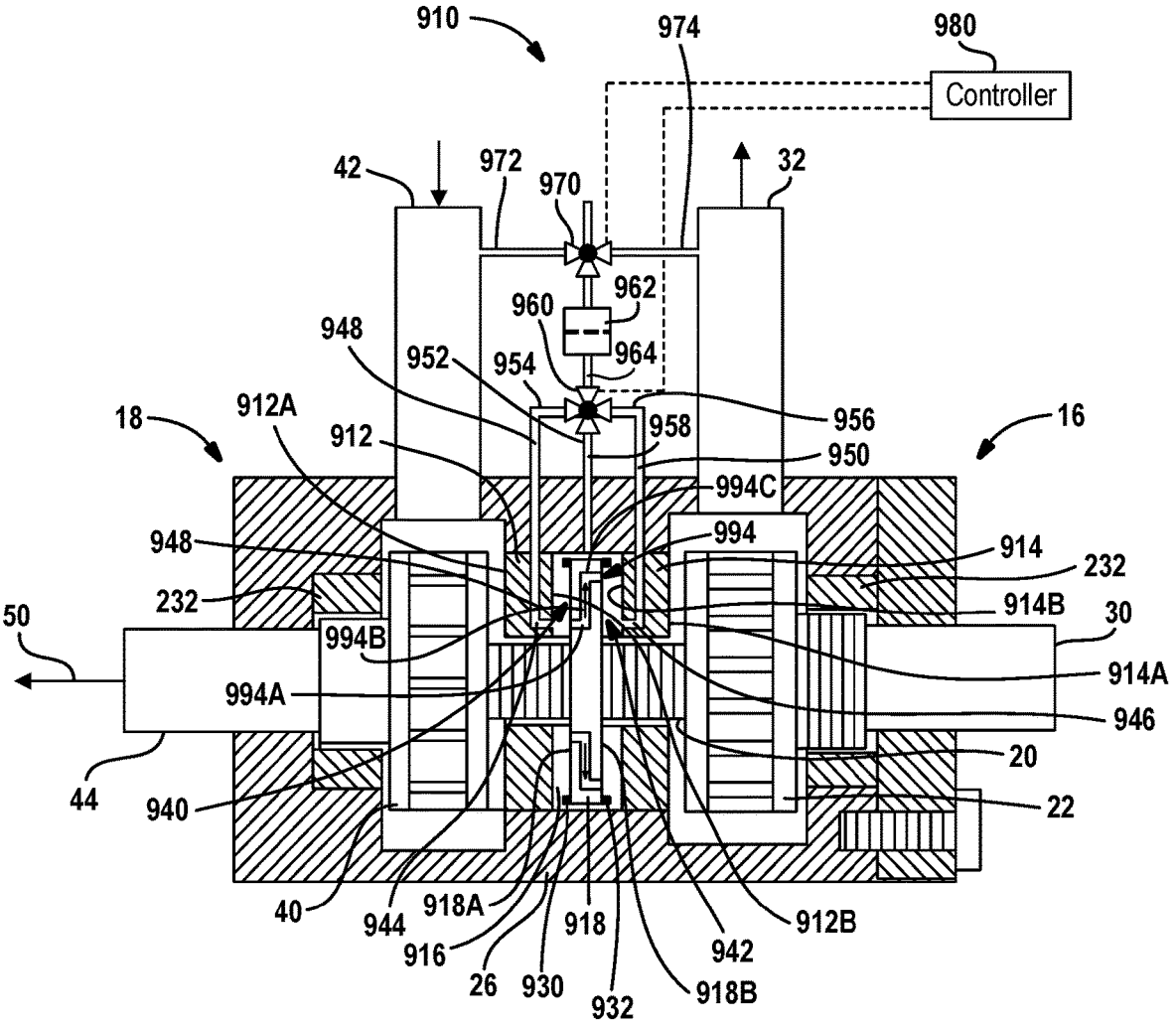
FIG. 8E is a cross-sectional view of a third example according to the present disclosure

Referring now to FIG. 8E, another embodiment of a flow channel within a balance disk 918 is set forth in a similar manner as that of FIG. 8D. However, in FIG. 8E, the predominant forces are in the direction of the pump portion 16. Therefore, a flow channel 994 is communicating fluid from the first side 918A of the balance disk which corresponds to the turbine portion to the second side 918B of the balance disk which corresponds to the pump side of the balance disk 918. In this example, the flow channel 994 includes a first axial portion 994A that is fluidically coupled to the first side 918A of the balance disk 918. A radial portion 994B communicates fluid from the first axial portion 994A to a second axial portion 994C. The second axial portion 994C communicates fluid to the second side 918B of the balance disk. In a similar manner to that described above with respect to FIG. 8D, fluid enters the first axial portion 994A adjacent to or proximate to the shaft 20. The pressure of the fluid within the flow channel 994 is increased by the centrifugal forces acting on the rotating balance disk 918. The fluid pressure increases within the radial portion 994B as the fluid traverses in the direction illustrated by the arrow toward the outward direction of the balance disk 918 away from the shaft 20. Higher pressure fluid then enters the thrust bearing located at the pump side of the balance disk 918. As mentioned above, the increased high pressure fluid into the thrust bearing increases the capacity of the thrust bearing, in this case, on the pump side of the hydraulic pressure booster 910.

Figure 9:
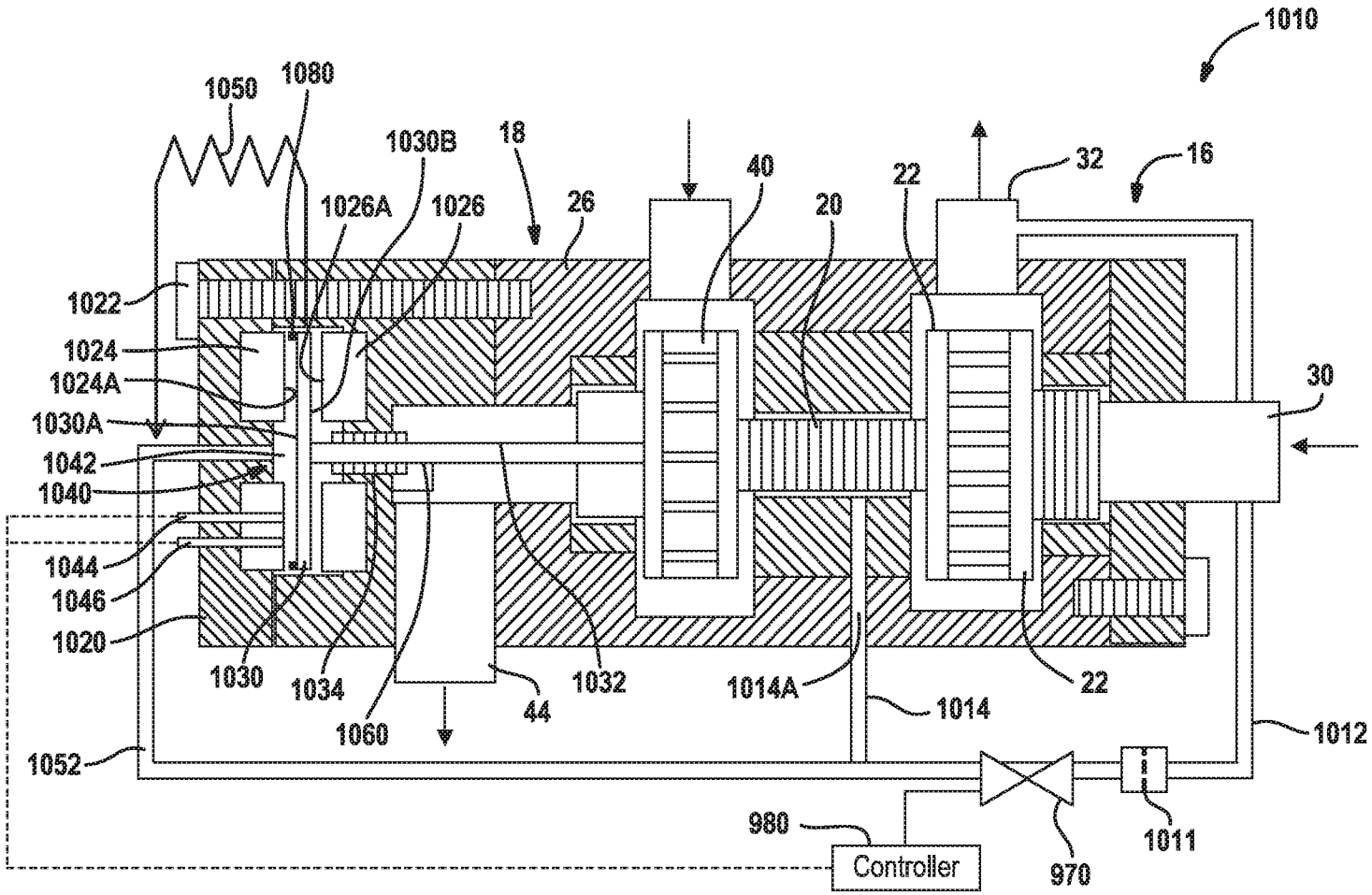
FIG. 9 is a fourth example of a hydraulic pressure booster according to a second example of the disclosure.

Referring now to FIG. 9, an alternative fluid machine 1010 is set forth. In this example, fluid is communicated from the pump outlet 32 to the filter 1011 disposed within a pipe 1012. A pipe 1014 may communicate fluid from the pump outlet to the shaft 20 between the turbine portion 18 and the pump portion 16 of the fluid machine 1010 such as a hydraulic pressure booster. In this example, the balance disk 1030 and balance disk chamber 1042 have been relocated outboard and adjacent to the turbine portion 18 of the fluid machine. The casing 26 may be supplemented with a casing extension or outer cap 1020 that is fastened with a bolt 1022 to a turbine end of the casing 26. The casing 26 and the outer cap 1020 may have a hollow space therebetween to house a first bearing 1024 and a second bearing 1026. The bearings 1024 and the bearings 1026 have inner surfaces 1024A and 1026A, respectively. The surface 1024A may form thrust bearing 1040 between surfaces 1030A of the balance disk 1030 within the volume defined by the wear ring 1080 disposed on the surface 1030A.

The flow channels 992, 994 illustrated in the balance disks illustrated in FIGS. 8D and 8E may also be incorporated within the balance disk 1030 to increase the capacity of the thrust bearings 1040.

A shaft extension 1032 may extend from the turbine portion 18 and the shaft 20 so that the balance disk 1030 and the wear ring 1080 rotates therewith. A shaft seal 1034 seals the shaft extension 1032 from leakage with the turbine outlet 44. The turbine outlet 44 is perpendicular to the shaft 20.

The pipe 1014 and the channel 1014A are provided closer to the pump impeller 22 than the turbine impeller 40. That is, the distance between the pump impeller 22 and the channel 1014A is less than the distance between the channel 1014A and the turbine impeller 40.

In operation, the rate of flow to the thrust bearing 1040 formed by a volume within the balance disk chamber 1042 between the bearing casing 1020, the balance disk 1030 and wear ring 1080.

A temperature sensor 1044 and a proximity sensor 1046 may be disposed within the bearing 1024 to generate a temperature signal corresponding to a temperature at the bearing 1024 and a proximity signal of the balance disk 1030 relative distance to the bearing 1024. The output of the temperature sensor 1044 may be used to control the heat exchanger 1050 and thus cool the fluid within the thrust bearing 1040. The fluid from the thrust bearing 1040 may be communicated through the heat exchanger 1050 and to the inlet pipe 1052 in a cooled state. The circulation through the heat exchanger 1050 is driven by the higher pressure caused by the rotating balance disk 1030. That is, a higher pressure exists at the outer diameter of the balance disk 1030 and thus the fluid may be communicated through the heat exchanger and back through the inlet pipe 1052.

The speed sensor 1060 may be used to monitor the rotational speed of the shaft extension 1032 which also corresponds to the rotational speed of the shaft 20. The speed sensor 1060 may be located within the turbine outlet 44 or adjacent to the temperature sensor 1044 and the proximity sensor 1046. A tooth or other indicator on the balance disk may provide the sensor with the rotational speed of the shaft.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification and the following claims.

What is claimed is:

1. A fluid machine comprising:

a pump portion having a pump impeller chamber, a pump inlet and a pump outlet;

a turbine portion having a turbine impeller chamber, a turbine inlet and a turbine outlet;

a shaft extending between the pump impeller chamber and the turbine impeller chamber;

a first bearing and a second bearing spaced apart to form a balance disk chamber;

a balance disk coupled to the shaft and disposed within the balance disk chamber;

a turbine impeller coupled to the shaft disposed within the turbine impeller chamber;

a first thrust bearing formed between the balance disk and the first bearing, said first thrust bearing receiving fluid from at least one of the pump outlet or the turbine inlet;

a first valve selectively coupling either the turbine inlet or the pump outlet to the balance disk chamber; and a second valve receiving fluid from the first valve and selectively coupling the fluid to the first thrust bearing or a second thrust bearing;

the first thrust bearing is formed on a first side of the balance disk and the second thrust bearing is formed on a second side of the balance disk.

2. The fluid machine as recited in claim 1 further comprising a filter filtering the fluid from the pump inlet into the first thrust bearing.

3. The fluid machine as recited in claim 1 wherein the balance disk is disposed between the pump portion and the turbine portion.

4. The fluid machine as recited in claim 1 wherein the first bearing comprises a turbine bearing and the second bearing comprises a pump bearing.

5. The fluid machine as recited in claim 1 further comprising a first channel and a second channel through a casing, said first channel and said second channel selectively coupled to the second valve.

6. The fluid machine as recited in claim 5 further comprising a third channel disposed between the first channel and the second channel, the third channel directed adjacent to a peripheral edge of the balance disk.

7. The fluid machine as recited in claim 6 wherein the second valve simultaneously communicates the fluid through the second channel and the third channel or simultaneously through the first channel and the third channel.

8. The fluid machine as recited in claim 1 wherein the balance disk is disposed adjacent to the turbine portion.

9. The fluid machine as recited in claim 8 wherein the balance disk is disposed within a disk casing.

10. The fluid machine as recited in claim 9 wherein the balance disk is disposed between the turbine outlet and a bearing casing.

11. The fluid machine as recited in claim 10 wherein the turbine outlet is perpendicular to the shaft.

12. The A fluid machine as recited in claim 11 wherein the balance disk is coupled to the shaft using a shaft extension.

13. The fluid machine as recited in claim 1 wherein the balance disk comprises a first side and a second side and a flow channel fluidically coupling the first side and the second side through the balance disk.

14. The fluid machine as recited in claim 13 wherein the first side corresponds to a pump side and the second side corresponds to a turbine side within the first thrust bearing.

15. The fluid machine as recited in claim 13 wherein the first side corresponds to a turbine side and the second side corresponds to a pump side within the first thrust bearing.

16. The fluid machine as recited in claim 13 wherein the flow channel comprises a first axial portion disposed adjacent to the shaft at the first side, a radial portion extending radially within the balance disk and a second axial portion extending axially to the second side radially outward from the shaft relative to the first axial portion.

17. A method of operating a fluid machine comprising:

forming a first thrust bearing on a first side of a balance disk and a second thrust bearing on a second side of the balance disk;

communicating fluid from a pump outlet or a turbine inlet to the first thrust bearing or the second thrust bearing formed by the balance disk coupled to a shaft by selectively coupling either the turbine inlet or the pump outlet to the balance disk chamber through a first valve;

receiving fluid from the first valve at a second valve;

selectively coupling the fluid to the first thrust bearing or a second thrust bearing from the second valve;

rotating the balance disk between the first thrust bearing and the second thrust bearing; and generating an axial force in response to communicating the fluid in response to communicating.

18. The method as recited in claim 17 wherein communicating fluid comprises communicating fluid to a bearing cavity between a pump portion and turbine portion of a hydraulic pressure booster.

19. The method as recited in claim 17 wherein communicating fluid comprises communicating fluid to a bearing cavity formed in a casing extension at a turbine end of a hydraulic pressure booster.

20. The method as recited in claim 17 further comprising coupling fluid from a first side of the balance disk to a second side of the balance disk through the balance disk.

21. The method as recited in claim 20 wherein coupling fluid comprises coupling fluid through a flow channel comprising a first axial portion disposed adjacent to the shaft at the first side, a radial portion extending radially within the balance disk and a second axial portion extending axially to the second side radially outward from the shaft relative to the first axial portion.

22. A fluid machine comprising:

a pump portion having a pump impeller chamber, a pump inlet and a pump outlet;

a turbine portion having a turbine impeller chamber, a turbine inlet and a turbine outlet;

a shaft extending between the pump impeller chamber and the turbine impeller chamber;

a first bearing and a second bearing spaced apart to form a balance disk chamber;

a balance disk coupled to the shaft and disposed within the balance disk chamber;

a turbine impeller coupled to the shaft disposed within the turbine impeller chamber;

a first thrust bearing formed between the balance disk and the first bearing, said first thrust bearing receiving fluid from at least one of the pump outlet or the turbine inlet; and a proximity sensor generating a proximity signal corresponding to a distance between the balance disk and the first bearing or the second bearing.

23. A fluid machine comprising:

a pump portion having a pump impeller chamber, a pump inlet and a pump outlet;

a turbine portion having a turbine impeller chamber, a turbine inlet and a turbine outlet;

a shaft extending between the pump impeller chamber and the turbine impeller chamber;

a first bearing and a second bearing spaced apart to form a balance disk chamber;

a balance disk coupled to the shaft and disposed within the balance disk chamber;

a turbine impeller coupled to the shaft disposed within the turbine impeller chamber;

a first thrust bearing formed between the balance disk and the first bearing, said first thrust bearing receiving fluid from at least one of the pump outlet or the turbine inlet; and a heat exchanger coupling in fluid communication with the balance disk chamber, the heat exchanger communicating fluid between the balance disk chamber and a thrust bearing inlet port.

* * * * *